United States Patent [19]

Posti

[11] 3,982,494

[45] Sept. 28, 1976

[54] AUXILIARY RUDDER FOR A JET PROPULSION UNIT

[76] Inventor: Jouko Juhani Posti, 95230 Maksniemi, Finland

[22] Filed: Mar. 24, 1975

[21] Appl. No.: 561,148

[30] Foreign Application Priority Data

Mar. 27, 1974 Finland ..... 930/74

[52] U.S. Cl. ..... 115/12 R

[51] Int. Cl.[2] ..... B63H 11/10

[58] Field of Search ..... 115/11, 12 R, 12 A, 115/14; 114/145 A, 164, 165, 168; 60/221, 222

[56] References Cited

UNITED STATES PATENTS

| | | | |
|---|---|---|---|
| 3,422,788 | 1/1969 | Horan, Jr. | 115/12 R |
| 3,478,712 | 11/1969 | Fox | 115/12 R |
| 3,613,630 | 10/1971 | Jacuzzi | 115/12 R |
| 3,728,983 | 4/1973 | Ingham | 114/16 J |
| 3,788,265 | 1/1974 | Moore | 115/12 R |

*Primary Examiner*—Trygve M. Blix
*Assistant Examiner*—Stuart M. Goldstein
*Attorney, Agent, or Firm*—Haseltine, Lake & Waters

[57] ABSTRACT

Auxiliary rudder apparatus for a water craft having a jet propulsion pump comprising an auxiliary rudder element coupled to the craft for movement between a raised inoperative position and a lowered operative position. A hydraulic cylinder operated by water pressure is coupled to the rudder element to move the same automatically to inoperative position when the craft is driven at sufficiently high speed that the water pressure of the pump is adequate to operate the hydraulic cylinder. The hydraulic cylinder is inoperative to move the rudder element to raised position both in forward and reverse travel of the craft below this high speed.

8 Claims, 2 Drawing Figures

AUXILIARY RUDDER FOR A JET PROPULSION UNIT

FIELD OF THE INVENTION

The present invention relates to jet propulsion units having an auxiliary rudder, which at low speeds descends below the bottom of the craft.

PRIOR ART

Auxiliary rudders connected to the steering nozzle of the craft are known, but their size is generally so small that they do not extend below the bottom of the craft. Additionally, they are immovable.

Such fixed auxiliary rudders have the drawback that if the rudder extends below the bottom of the craft, it will be damaged when striking an obstacle. Furthermore, the auxiliary rudder will retard the progress of the craft at high speeds. If the rudder is small to preclude such retardation at high speed, it will not appreciably improve the steerability of the craft, this being exceedingly poor in jet-propelled boats driven at low speeds.

SUMMARY OF THE INVENTION

The auxiliary rudder according to the invention is characterized by the construction in which when the craft travels at high speed, the rudder is raised by the force from a hydraulic cylinder utilizing the water pressure produced by the jet pump.

The rudder according to the invention can be made large enough to maintain the steerability when the craft is traveling at low speeds, while at high speeds it is automatically raised and does not impede the advance of the craft. Additionally, the rudder is safe from damage because it is in the raised position when it is not needed.

BRIEF DESCRIPTION OF THE DRAWING

In the attached drawing, an auxiliary rudder according to the invention is illustrated, mounted on the steering nozzle of a jet propulsion unit, and wherein.

DETAILED DESCRIPTION

Figure 2:
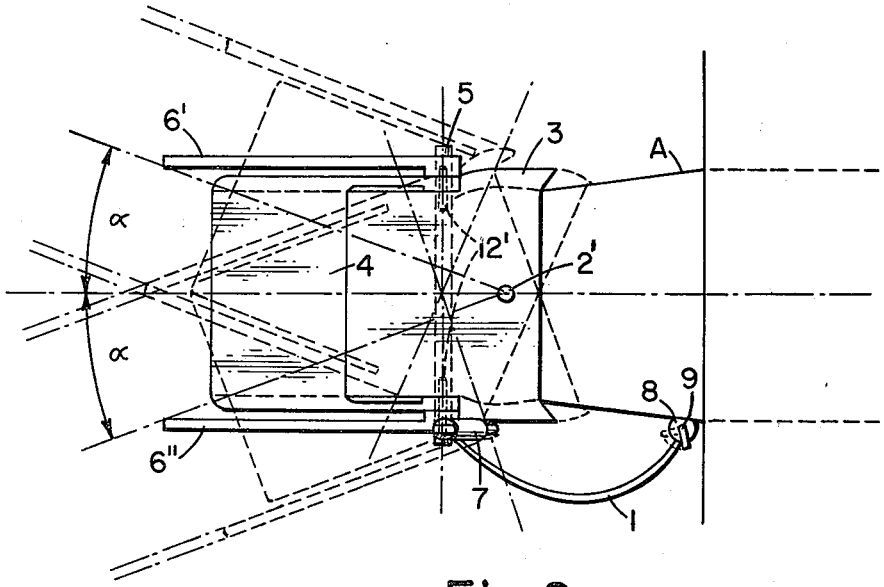
FIG. 2 shows the device in top plan view.

Referring to the drawing, therein is seen a pump housing A for a jet pump which discharges water to propel the craft B. A steering nozzle 3 is connected by pins 2', 2'' to the housing A so as to be pivotable thereon through angle $\alpha$ as shown in dotted outline in FIG. 2 to control the steering of the craft.

An auxiliary rudder 6 composed of rudder plates 6', 6'' is connected by axle 5 to the steering nozzle 3. Reference numeral 7 designates a water pressure-operated hydraulic cylinder, whose inlet is connected to the tube 1 to receive water via valve 8 from the pump chamber in housing A. A rod 10 is secured to rudder 6 and enables the rudder 6 to be raised by hand, and the rod may be replaced by a line, one end of which is fixed in a hole 11 and the other end, for instance, to the tailboard of the craft.

A rod 9 can act on the valve 8 to enable the rudder to be locked in its raised position.

Numeral 4 designates a reversing means, in the form of a scoop, mounted on the steering nozzle 3 by means of pins 12. The upper end of cylinder 7 is mounted on one of the pins 12.

A pin 13 connects the lower end of the cylinder 7 with the auxiliary rudder 6.

Figure 1:
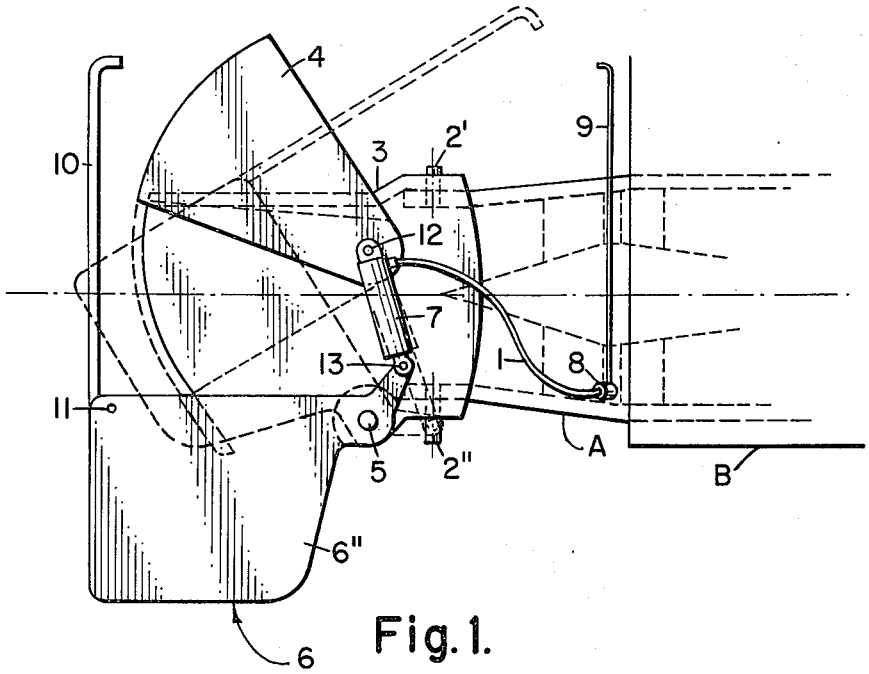
FIG. 1 shows the device in elevational view.

The operation of the auxiliary rudder is as follows:

When the craft is proceeding at low speed, the pressure in the pump chamber A is low and the cylinder 7 cannot hold the auxiliary rudder 6 in the raised position; instead, it descends as shown in FIG. 1 in solid lines and thereby the steering capacity of the craft is increased. When the speed is increased, the pressure in pump chamber A increases and the cylinder 7 thereby raises the auxiliary rudder 6 out of the water when the craft is planing. In this condition, the rudder is not required to contact the water since the steering nozzle 3 alone is able to effect the steering.

The system also operates when the craft is reversed upon lowering the scoop 4, as shown in dotted lines in FIG. 1, which deflects the water jet from pump chamber A toward the bow. Namely, the auxiliary rudder is lowered as before. The auxiliary rudder may be locked in its raised position by raising it by means of the rod 10, whereby a suction effect causes water to flow into the cylinder 7 through the tube 1; when subsequently the valve 8 is closed, the water cannot escape from the cylinder 7 and the rudder 6 is kept raised, where it is protected from impacts as the craft is being anchored in shallow water. The valve 8 may be closable manually by the rod 9 or this may be an electromagnetic valve, in which case the rudder may also be locked in the raised position from the driver's seat while driving.

The two auxiliary plates 6', 6'' are mounted on shaft 5 e.g. with cotter pins, and the cylinder 7 suffices to effect the raising operation of both plates.

A water craft fitted with a jet propulsion unit is known to have poor steerability when driven at low speeds. However, when such craft is fitted with an auxiliary rudder according to the invention, the steerability is satisfactory and at high speeds the rudder does not contact the water because it is automatically raised by water pressure. The speed of the boat is dependent on the velocity of the water jet, and the boat attains about 70% thereof. The velocity of the jet depends on the hydrostatic head generated by the pump. Several calculations will best illustrate the operation.

Knowing the hydrostatic head, the velocity of the jet is found from the formula $v = \sqrt{2gh}$.

Assuming that the boat is travelling at 10 knots, whereat the rudder should be lowered, and that the slip is 30% of the jet velocity, then there must be, in the chamber A, approximately 3 m hydrostatic head (or a pressure of 0.3 kp/cm$^2$), which is not sufficient to keep the rudder raised. However, when the speed of the boat is 20 knots, there has to be 1.1 kp/cm$^2$ in the chamber A to produce the requisite jet velocity, and this pressure suffices to keep the auxiliary rudder in raised inoperative position. It is possible by changing the diameter of the cylinder 7 and by shortening or lengthening the lever arm of the rudder 6 to make the auxiliary rudder remain in raised position at any desired speed. The device also operates when the boat is driven in reverse, which is of great importance. It is understood, of course, that the shape and the weight of the auxiliary rudder also possesses essential significance with regard to the operation of the device.

From the above, it is seen that the invention contemplates auxiliary rudder apparatus for a water craft which is driven by a jet propulsion pump, wherein said apparatus comprises auxiliary rudder 6 coupled to the craft for movement between the raised inoperative position as shown in dotted outline in FIG. 1, and the lowered operative position as shown in solid lines in FIG. 1. The rudder is operated by hydraulic cylinder 7 which in turn is operated by water pressure from the pump so as to automatically move the rudder to its inoperative position when the craft is driven at sufficiently high speed. When the hydraulic cylinder 7 is inoperative, the rudder 6 is in lowered operative position, and this is true both for forward and reverse travel of the craft at relatively low speed.

Numerous modifications and variations of the disclosed embodiment of the invention will become obvious to those skilled in the art without departing from the scope and spirit of the invention as defined in the attached claims.

What is claimed is:

1. Auxiliary rudder apparatus for a water craft having a jet propulsion pump with a housing and a nozzle pivotably mounted on the housing for discharge of a propulsion jet, said apparatus comprising an auxiliary rudder element pivotably mounted on the nozzle for movement between a raised inoperative position and a lowered operative position, and a hydraulic cylinder coupled to the pump and the rudder element and operated by water pressure delivered by the pump to move the rudder automatically in inoperative position when the craft is driven at sufficiently high speed that the water pressure of the pump is adequate to operate the hydraulic cylinder.

2. Auxiliary rudder apparatus as claimed in claim 1 wherein said hydraulic cylinder has a retracted position in which it is inoperative to move the rudder element to raised position both in forward and reverse travel of the craft below said sufficiently high speed.

3. Auxiliary rudder apparatus as claimed in claim 1 comprising means on said rudder element for manually effecting raising thereof to said inoperative position.

4. Auxiliary rudder apparatus as claimed in claim 3 wherein said means comprises a rod fixed to said rudder element.

5. Auxiliary rudder apparatus as claimed in claim 1 comprising means for locking said hydraulic cylinder to lock said rudder element in the raised position.

6. Auxiliary rudder apparatus as claimed in claim 5 wherein the locking means comprises a valve means coupled to the hydraulic cylinder for controlling water discharge therefrom.

7. Auxiliary rudder apparatus as claimed in claim 1 comprising a scoop member mounted on the nozzle and movable between an inoperative position out of the path of jet discharge from the nozzle, and an operative position in which it deflects the water jet from the nozzle forwardly to reverse the direction of the craft.

8. Auxiliary rudder apparatus as claimed in claim 7 comprising pins supporting said scoop member for pivotal movement, said hydraulic cylinder being connected at one end to said rudder element and at its other end to one of said pins.

* * * * *